US007866667B2

(12) United States Patent
Fruchtman

(10) Patent No.: US 7,866,667 B2
(45) Date of Patent: Jan. 11, 2011

(54) CARD DISPENSER AND STORAGE AND METHOD FOR DISPENSING AND STORING CARDS

(76) Inventor: Jerry Fruchtman, P.O. Box 2351, Manhattan Beach, CA (US) 90267

( * ) Notice: Subject to any disclaimer, the term of this patent is extended or adjusted under 35 U.S.C. 154(b) by 243 days.

(21) Appl. No.: 11/288,805

(22) Filed: Nov. 29, 2005

(65) Prior Publication Data

US 2007/0120321 A1 May 31, 2007

(51) Int. Cl.
*A63F 1/06* (2006.01)
*A63F 1/14* (2006.01)
*A63F 1/10* (2006.01)

(52) U.S. Cl. ..... 273/148 A; 273/148 R; 273/149 R; 273/150

(58) Field of Classification Search ..... 273/149 R, 273/149 P, 148 A, 148 R, 150
See application file for complete search history.

(56) References Cited

U.S. PATENT DOCUMENTS 1,173,843 A * 2/1916 Morten ..... 206/39.3
1,246,297 A * 11/1917 Michell ..... 273/148 A
2,631,042 A * 3/1953 Bertram ..... 273/148 A
5,226,532 A * 7/1993 Davidson et al. ..... 206/232
5,472,198 A * 12/1995 Alvarez ..... 273/150
5,685,543 A 11/1997 Garner
D426,703 S * 6/2000 Kojoori ..... D3/249
6,203,012 B1 3/2001 Peron
6,823,910 B1 * 11/2004 Elnekaveh ..... 150/147
2004/0016653 A1 * 1/2004 Hage ..... 206/39

* cited by examiner

*Primary Examiner*—Gene Kim
*Assistant Examiner*—Michael D Dennis
(74) *Attorney, Agent, or Firm*—Triangle Patents

(57) ABSTRACT

A dispenser and storage system for cards allows a user to store, dispense, hold, and play a game of cards even when the dealer must hold the deck in one hand or in a windy environment. The system includes a container adapted to store at least one card, a cutout, a slot adapted to dispense at least one card, and a flap. The container may include a clip for holding cards and carrying the container. A process for storing and dispensing cards is also described.

4 Claims, 4 Drawing Sheets

CARD DISPENSER AND STORAGE AND METHOD FOR DISPENSING AND STORING CARDS

BACKGROUND OF THE INVENTION

1. Field of the Invention

The invention relates to a device for dispensing and storing cards and a method for dispensing and storing cards. More particularly, the invention relates to a device and method for dispensing and storing playing cards to minimize their loss during motion.

2. Description of Related Art

Playing cards have been known for over six-hundred years and are the basis of a large number of games. Card games cover a wide range from contemplative, e.g., bridge, to amusing, e.g., fish. A universal aspect of these games is that a player (or players) use and/or replace (discard) cards, often several times in a single game. In such games, there exist at least three groups of cards: dealt cards, un-dealt cards, and discarded cards. Typically, the dealt cards are also the cards currently being played. There can exist, however, a fourth group of played cards, separate from the dealt cards.

Managing these various groups of cards is not only important for the players but also for the integrity of the game being played. Cheating in card games often occurs when players deviously and surreptitiously intermix cards in these groups. Even to an honest player, card management can be difficult in the presence of factors such as wind and player movement or if the number of cards is large. While most card games are played with a single deck of fifty-two cards, many games exist that use multiple decks.

Card holders and storage devices are well known in the art. Generally, cards are stored in the box that they originally came in. Casinos and other gaming establishments that use a large number of cards use holders, also known as "shoes", that are able to hold multiple decks of cards. These shoes may further include slots for inserting and/or removing (dealing) the cards.

Garner (U.S. Pat. No. 5,685,543, the contents of which are herein incorporated in their entirety by reference) discloses a playing card holder and dispenser that include a sleeve that is mounted on a table into which a card storage container is inserted. The container further contains a card support member on a pair of springs that force cards upwards to a slot from which they can be dispensed. This type of device is bulky and complicated due to the presence of several parts (including springs, sleeves, etc.). Therefore, it is designed for indoor use (e.g., in a casino).

While many people enjoy playing card games in casinos and other gaming establishments, a significant amount of card playing occurs at private establishments such as homes. In addition, playing cards while traveling is a fun and effective way to pass time while providing entertainment. At rest, playing a game of cards away from a flat surface such as a table is possible, though often inconvenient. While in motion or under windy conditions, playing cards is both difficult and inconvenient because the cards are easily scattered by the wind.

Therefore, there exists a need in the industry for a device that can dispense, store, and hold cards, especially one that is minimizes the effect of motion and other adverse effects (e.g., wind).

BRIEF SUMMARY OF THE INVENTION

It is accordingly an object of the invention to provide a card dispenser and storage and a method for dispensing and storing cards that overcome the above-mentioned disadvantages of the heretofore-known devices and methods of this general type.

With the foregoing and other objects in view there is provided, in accordance with the invention, a device for dispensing and storing at least one card. The device includes a container and a flap. The container is adapted to store a deck of cards and has a cutout formed therein. The dealer can push a top card from the deck by reaching with his thumb to the top card and pushing it from the container out a slot. The slot is adapted to dispense the card. The flap is connected to the container to the side of the container opposite of the cutout and is configured to block the card from exiting the container through the slot when the flap is in a closed position. A closed position is when the flap is between the top card and the side of the container with the cutout. In an opened position, the flap is folded under the deck and folded upward to block the side except to form the slot. The flap under the deck also acts to urge the deck of cards upward toward the side of the container with the cutout.

One aspect of the invention is directed towards a container for storing cards.

Another aspect of the invention is directed towards a container for storing cards that can act as a dispenser for the cards.

Another aspect of the invention is directed towards a container for storing and dispensing cards, wherein the container minimizes the effects of motion.

Another aspect of the invention is directed to a system for dispensing and storing cards wherein the system includes a container adapted to store at least deck of playing cards, a cutout, a slot adapted to dispense at least one card, and a flap.

Another aspect of the invention is directed towards a method for storing and dispensing cards that allow a dealer to hold a deck and the dealer's playing cards in one hand while dealing cards to other players without the use of a flat surface such as a table.

A further object of the invention is to allow a dealer to play cards without a flat surface such as a table by allowing the dealer to hold a deck, dispense cards from the deck, deal cards to other players, and hold a hand of cards, all with using only one hand.

Other features that are considered as characteristic for the invention are set forth in the appended claims.

Although the invention is illustrated and described herein a card dispenser and storage and a method for dispensing and storing cards, it is nevertheless not intended to be limited to the details shown because various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
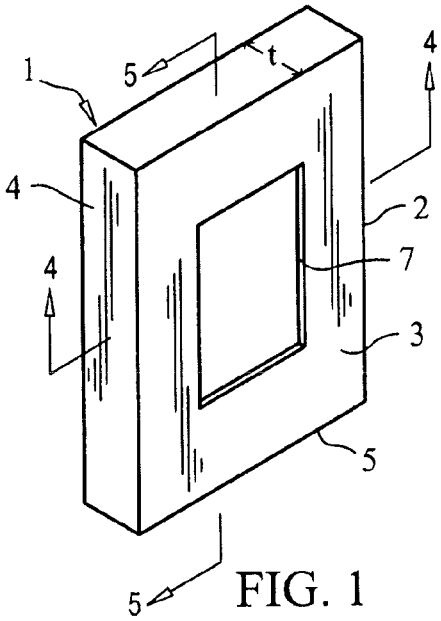
FIG. 1 is a diagrammatic top left perspective view of a card storage and dispenser system according to the present invention.
Figure 2:
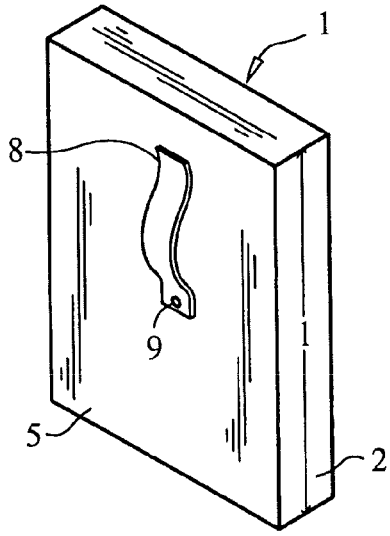
FIG. 2 is a bottom perspective view of the card storage and dispenser system shown in FIG. 1.

Referring now to the figures of the drawing in detail and first, particularly, to FIGS. 1 thereof, there is seen a top view of a card storage and dispenser system 1 according to the present invention. The card storage and dispenser system 1 includes a container 2 having a thickness t, a length l, and a width w.

In one embodiment of the present invention, t is from about ten centimeters to five hundredths of a centimeter (10-0.05 cm). In a more preferred embodiment of the present invention, t is the thickness of a deck of playing cards, i.e., from about two centimeters to one centimeter (2 cm-1 cm). In a most preferred embodiment of the present invention, t is about one and five tenths centimeters (1.5 cm). This invention is conceived to encompass multiple decks of cards stacked on top of each other, i.e., t can be multiples of one and five tenths centimeters (×1.5 cm).

In one embodiment of the present invention, l is from about seven to eleven centimeters (7-11 cm). In a more preferred embodiment, l is from about eight to ten centimeters (8-10 cm). In a most preferred embodiment, l is about nine centimeters (9 cm).

In one embodiment of the present invention, w is from about five centimeters to about nine centimeters (5-9 cm). In a more preferred embodiment, w is from about six to seven centimeters (6-7 cm). In a most preferred embodiment, w is about six and five tenths centimeters (6.5 cm).

FIG. 1 also shows a cutout 7 in the top 3 of the container 2. The cutout 7 is shown as a rectangle formed in the center of the top 3. However, it is within the scope of this invention that the cutout 7 can be of any shape including square, circular, oval, triangular, pentagonal, hexagonal, and octagonal and be disposed anywhere on the top 3. In one embodiment of the present invention, the cutout 7 has an area of about forty square centimeters (40 $cm^2$) to about one square centimeter (1 $cm^2$). In a more preferred embodiment of the present invention, the cutout 7 has an area of about twenty-five square centimeters (25 $cm^2$) to about fifteen square centimeters (15 $cm^2$). In a most preferred embodiment of the present invention, the cutout 7 has an area of from about eight to ten square centimeters (8-10 $cm^2$).

FIGS. 2-8 show further views of the card storage and dispenser system 1. The container 2 includes a bottom 6, at least one length side 4, and at least one width side 5. The length side 4 has a length l noted above and the width side 5 has a width w also noted above. The bottom 6 further includes a clip 8 attached to the bottom 6 by a connector 9. The clip 8 is similar to prior-art belt clips for pagers and tape measures and it is fully contained within the area of the bottom 6. It is within the scope of this invention that the clip 8 be of any shape including triangular, rectangular, square, circular, oval, pentagonal, hexagonal, and octagonal. The clip 8 is also shown attached roughly about the center of the bottom 6 by the connector 9. It is within the scope of this invention, however, that the clip 8 be attached anywhere about the bottom 6 on either, or all of, the length side 4 and the width side 5. Furthermore, multiple clips 8 can be disposed on any of the bottom 6, the length side 4, and the width side 5. The clip 8 can also extend beyond the area of the bottom 6.

The connector 9 attaches the clip 8 to the bottom 6. Any type of connection can be used for the attachment. Examples include clasps, buttons, nails, screws, hook and loop fasteners such as those sold under the trade name VELCRO®, adhesives, and clasps. In a preferred embodiment, the connector 9 can swivel. The connector 9 is configured to allow a user to clip the card storage and dispenser system 1 to his/her belt, pocket, etc. The connector 9 is also designed to exert sufficient pressure against the bottom 6 to securely hold at least one card 10 (shown in FIG. 7).

The card storage and dispenser system 1 further includes a flap 12 interconnected to the bottom 6 by section 13 at joint 15. Section 13 optionally further includes a hinge 11 disposed between the section 13 and the flap 12. The section 13 is almost as thick as the thickness t of the container 2. By being not as thick as the thickness t, a slot 14 is defined. The slot is preferably equal in thickness to the thickness of one card.

Figure 3:
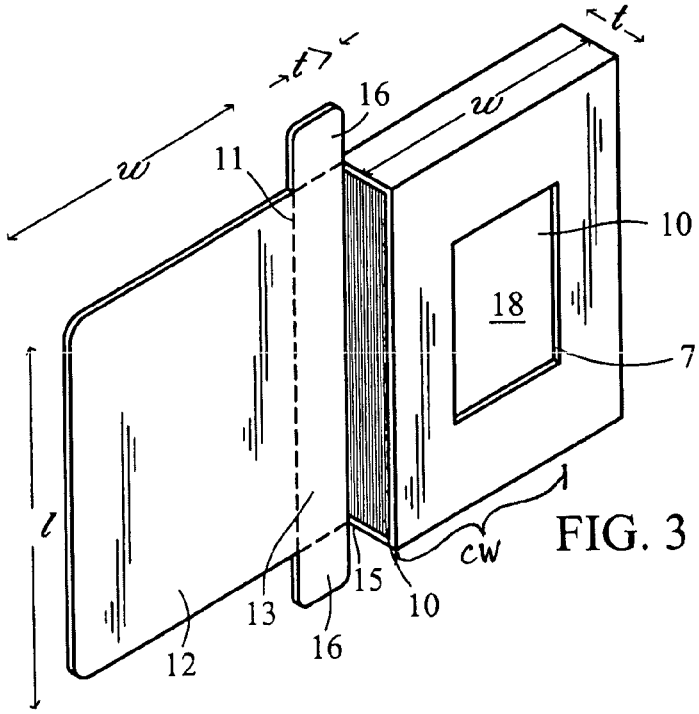
FIG. 3 is a top right perspective view of a card storage and dispenser system showing a flap in the open position.

FIG. 3 shows the card storage and dispenser system 1 with the flap 12 in an open configuration. In this configuration, the user can insert at least one card 10 into the container 2. In a preferred embodiment, the user inserts a deck of playing cards into the container 2. The tabs 16 are also visible in FIG. 3.

Figure 8:
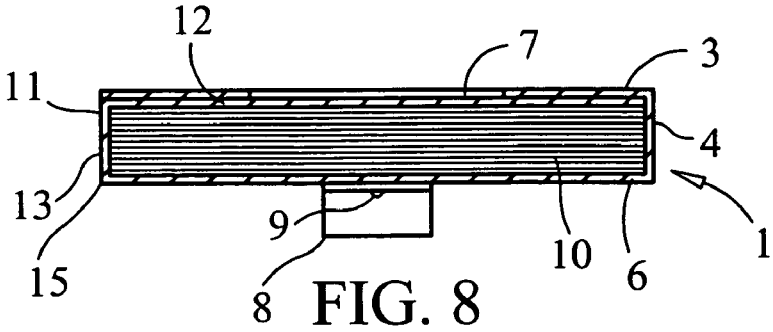
FIG. 8 is a cross-sectional view of the card storage and dispenser system taken along line 4-4 shown in FIG. 1 with the flap in a playing position beneath the cards.
Figure 6:
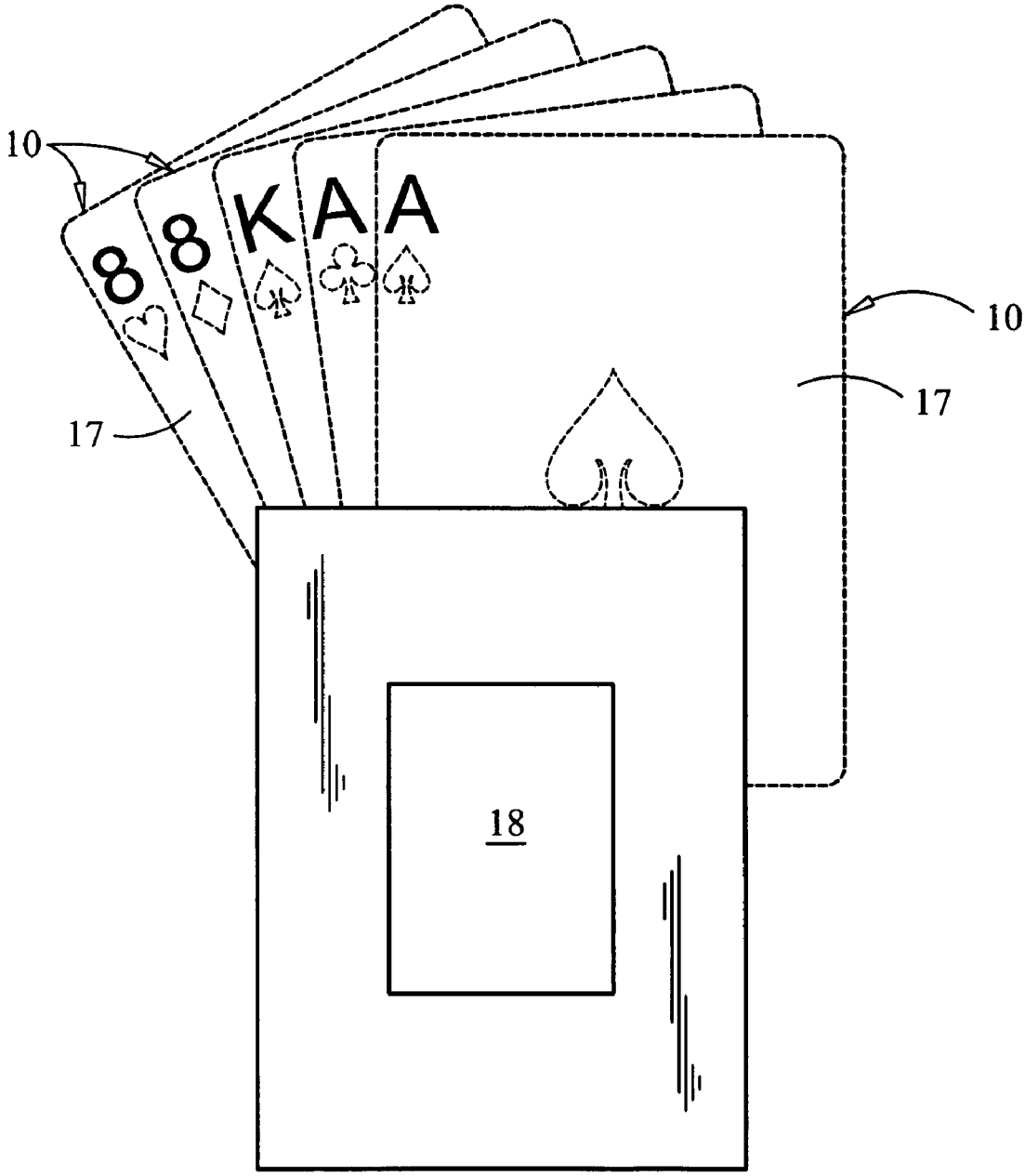
FIG. 6 is a top side view showing the clip holding cards.

In a closed position as shown in FIG. 8, the flap 12 is disposed between the deck of cards 10 and the top 3 and prevents access to the cards through via the cutout 7 by having a width cw great enough to close cutout 7. In a preferred embodiment of the present invention, the flap 12 has the length 1 and the width w. The section 13 is configured to almost equal the thickness t of the length side 4.

Figure 4:
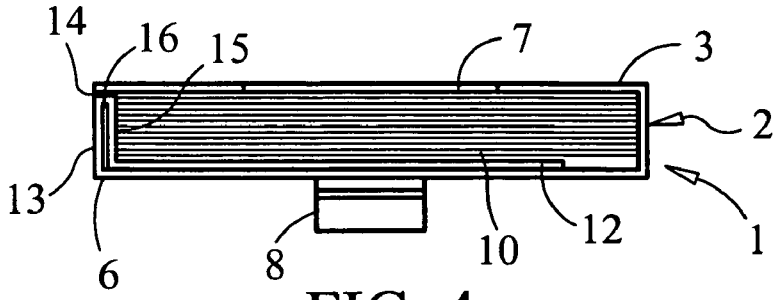
FIG. 4 is a cross-sectional view of the card storage and dispenser system taken along line 4-4 shown in FIG. 1 with the flap above the cards in a closed position.
Figure 5:
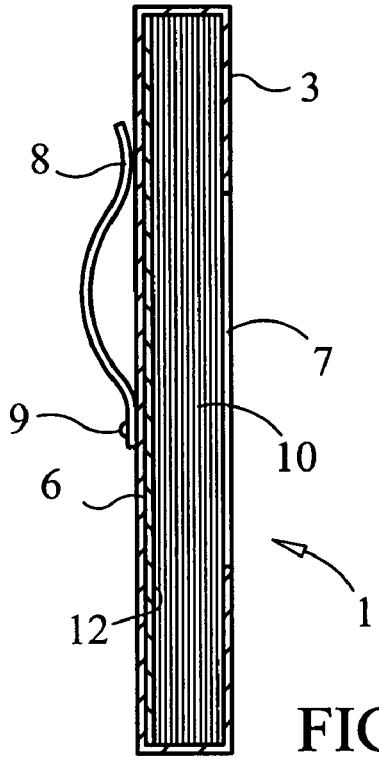
FIG. 5 is a cross-sectional view of the card storage and dispenser system taken along line 5-5 shown in FIG. 1 with the cards stacked therein.

In a playing position as shown in FIG. 4, the hinge 11, joint 15, and section 13 permit the flap 12 to fold under the cards 10 and lie substantially parallel to the bottom 6. The tabs 16 are folded upward and inserted within the box to help hold the hinge 11 closed during play. The flap 12 is made of a flexible resilient material such as cardboard or plastic. The combination of any one, or all, of the hinge 11, flap 12, section 13, and joint 15 and the resilient nature of the material exert an upward pressure on at least one card 10 in the container 2 forcing the card 10 towards the cutout 7. In addition, the dealer, while holding the container 2 can hold the section 13 closed (as in FIG. 4), with an index finger. In an embodiment that is not shown, clips can be added to the section 13 to lock the section 13 to the top 3.

FIG. 4 is a cross-sectional view of the card storage and dispenser system 1 showing the flap 12 under a deck of cards 10. Also shown are the clip 8 and the connector 9. As noted earlier, the cards 10 are pushed towards the cutout 7 by the underlying flap 12. Once a card 10 reaches the cutout 7, the user can dispense the card 10 through a slot 14. Typically, the user inserts a finger in the cutout and pushes the card 10 towards, and out of, the slot 14. The slot 14 allows the card 10 to exit the container 2. In a preferred embodiment of the present invention, the slot 14 is configured to permit egress of only one card 10.

Figure 7:
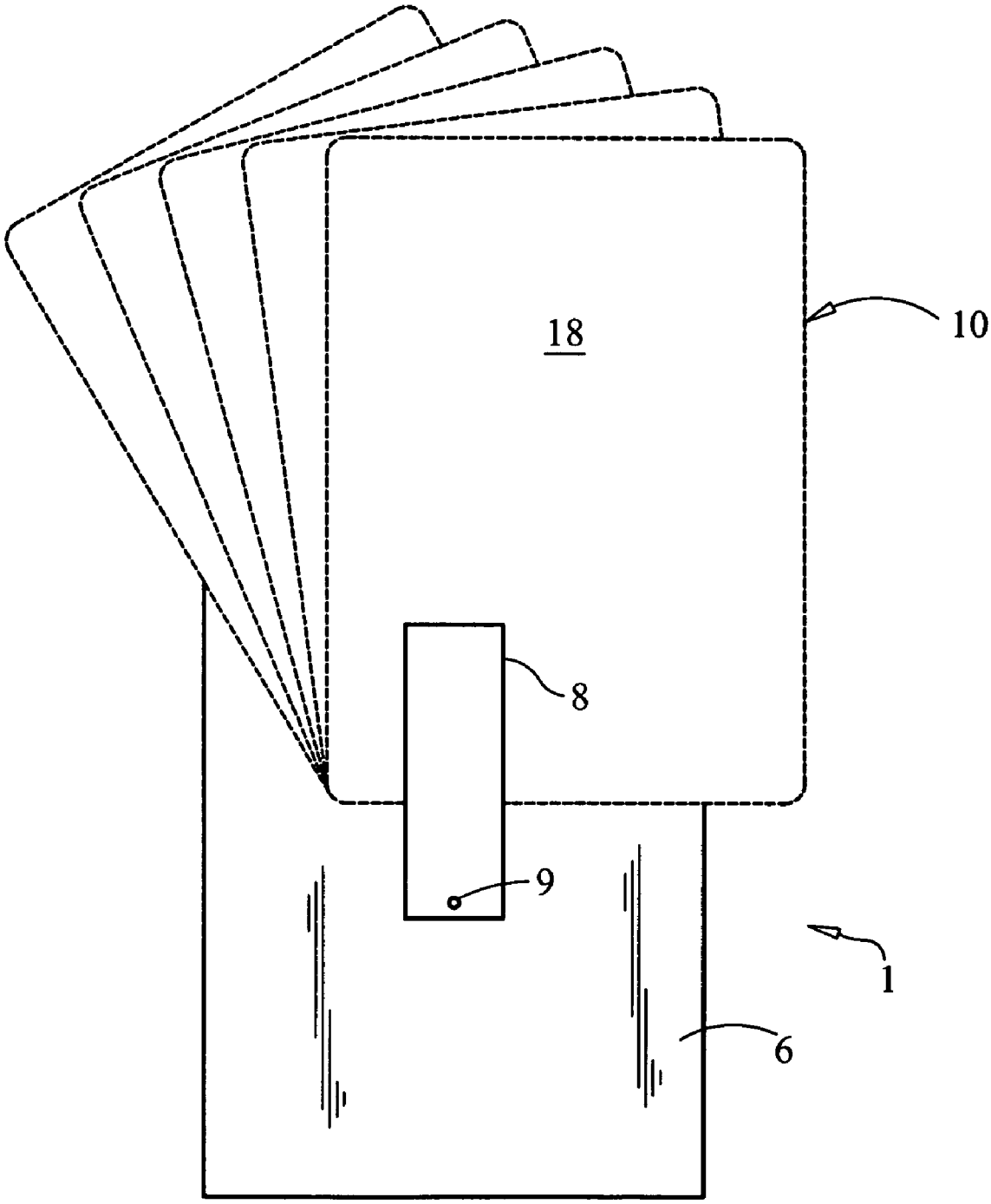
FIG. 7 is a bottom side view showing the clip holding cards.

FIG. 7 shows the bottom 6 of the card storage and dispenser system 1. The clip 8 is shown holding cards 10. The cards 10 can be fanned out as shown to form a hand that is being played or can be collected together as the discard pile. The swivelability of the clip 8 around the connector 9 is advantageous as the swivilability allows the clip 8 to be used as a holder of cards 10 as well as a method of carrying the card storage and dispenser system 1. The clip 8 can be used as a belt clip to carry a deck of cards between games.

The card storage and dispenser system 1 can be used to store and dispense any type of cards 10. In a preferred embodiment of the present invention, the card storage and dispenser system 1 is used for playing cards 10; each card 10 has a face 17 and a back 18. To begin a game, a deck of cards 10 is placed within the container 2 with the back 18 of the cards being visible through the cutout 7. Next, the flap 12 placed beneath the deck of cards 10 and the section 13 is folded up. The tabs 16 are also folded and help the section 13 to stay folded. The dealer then holds the container 2 in their left hand with the cutout 7 facing upward. To deal, the dealer pushes the top card with his thumb via the cutout 7 out the slot 14; this can be done using only one hand. The dealer holds his hand of cards 10 by placing the cards 10 in the clip 8 facing upward.

It can thus be appreciated that the aspects of the present invention have been fully and effectively described. The foregoing specific embodiments have been provided to illustrate the structural and functional principles of the present invention, and are not intended to be limiting. To the contrary, the present invention is intended to encompass all modifications, alterations and substitutions within the spirit and scope of the detailed description. For example, while this invention has been described in terms of playing cards, it is well understood by one of ordinary skill in the art that the term "cards" could refer to any type of card-like material including greeting cards, tarot cards, business cards, identity (ID) cards, etc.

What is claimed is:

1. A card carrier and dispenser, comprising:

a generally horizontal bottom face;

a generally horizontal top face, the top face including a cut-out in a portion thereof;

at least three side faces, the side faces extending generally vertically between the top face and the bottom face, the bottom face, top face, and the at least three side faces being arranged such that the carrier has a pair of long sides and a pair of short sides and defines an internal space sized and adapted to contain at least one deck of cards; and a flap connected to an interconnecting section, which is connected to the bottom face at a joint along one of the long sides and extending outwardly therefrom, the interconnecting section connected to the flap at a hinge spaced from the joint by a distance just less than a thickness of the card carrier between the bottom face and the top face;

wherein the interconnecting section of the flap has a length just less than the thickness of the card carrier between the bottom face and the top face;

wherein the flap and interconnecting section are constructed and arranged to assume and be moved between three positions, (1) a closed position, in which the flap is folded upwardly and tucked in below the top face but above a deck of cards contained in the dispenser, thereby closing the card carrier, (2) a slot-defining position, in which the flap is tucked in below cards contained in the dispenser and the interconnecting section leaves an open slot between itself and the top face; the slot defined by the interconnecting section being of a size and dimension such that only one generally rectangular card may be advanced with a single hand out of the card carrier through the slot with a long side protruding and (3) an open position, in which the flap and interconnecting section leaves the internal space of the carrier essentially open;

wherein the flap is constructed and arranged to push a card disposed in the card carrier toward the slot when the flap is disposed in the slot-defining position; and further comprising a clip connected to the exterior of the bottom face, the clip being constructed and adapted to releasably hold one or more cards to the card carrier, wherein the clip is connected to the exterior of the bottom face through a swivel, the swivel allowing the clip to rotate with respect to the bottom face.

2. The card carrier of claim 1, wherein the flap covers the cut-out when the flap is in the closed position.

3. The card carrier of claim 1, wherein the cut-out is generally rectangular in shape.

4. A card carrier and dispenser, comprising:

a generally horizontal bottom face; a generally horizontal top face, the top face including a cut-out in a portion thereof;

at least three side faces, the side faces extending generally vertically between the top face and the bottom face, the bottom face, top face, and the at least three side faces being arranged such that the carrier has a pair of long sides and a pair of short sides and defines an internal space sized and adapted to contain at least one deck of cards;

a flap connected to an interconnecting section which is connected to the bottom face along one of the long sides at joint and extending outwardly therefrom, the interconnecting section connected to the flap at a hinge spaced from the joint by a distance just less than a thickness of the card carrier between the bottom face and the top face;

wherein the interconnecting section has a length just less than the thickness of the card carrier between the bottom face and the top face;

wherein the flap and interconnecting section are constructed and arranged to assume and be moved between two positions, (1) a closed position, in which the flap is folded upwardly and tucked in below the top face but above a deck of cards contained in the dispenser, thereby closing the card carrier, and (2) a slot-defining position, in which the flap is tucked in below cards contained in the dispenser and the interconnecting section leaves an open slot between itself and the top face, the slot defined by the interconnecting section being of a size and dimension such that only one generally rectangular card may be advanced with a single hand out of the card carrier through the slot with a long side protruding, the flap having dimensions sufficient to cover the cut-out when the flap is in the closed position, and being constructed and adapted to urge the card toward the slot in the slot-defining position; and further including a clip constructed and adapted to hold one or more cards against the bottom face, and wherein the clip is connected to the exterior of the bottom face through a swivel, the swivel allowing the clip to rotate with respect to the bottom face.

* * * * *